US007871355B2

(12) United States Patent
Yeh

(10) Patent No.: US 7,871,355 B2
(45) Date of Patent: Jan. 18, 2011

(54) VIBRATION TRAINING DEVICE

(75) Inventor: Don-Lon Yeh, Taichung (TW)

(73) Assignee: Sin Lin Technology Co., Ltd., Taichung (TW)

( * ) Notice: Subject to any disclaimer, the term of this patent is extended or adjusted under 35 U.S.C. 154(b) by 0 days.

(21) Appl. No.: 12/710,314

(22) Filed: Feb. 22, 2010

(65) Prior Publication Data

US 2010/0151994 A1 Jun. 17, 2010

Related U.S. Application Data

(63) Continuation-in-part of application No. 11/979,476, filed on Nov. 5, 2007, now abandoned.

(51) Int. Cl.
*A63B 24/00* (2006.01)

(52) U.S. Cl. ..... 482/4; 482/1

(58) Field of Classification Search ..... 482/1, 482/4

See application file for complete search history.

(56) References Cited

U.S. PATENT DOCUMENTS 3,848,467 A * 11/1974 Flavell ..... 482/4
3,869,121 A * 3/1975 Flavell ..... 482/2
4,082,267 A * 4/1978 Flavell ..... 482/6
4,184,678 A * 1/1980 Flavell et al. ..... 482/6
4,261,562 A * 4/1981 Flavell ..... 482/6
4,822,037 A * 4/1989 Makansi et al. ..... 482/6
4,842,274 A * 6/1989 Oosthuizen et al. ..... 482/5
7,682,287 B1 * 3/2010 Hsieh ..... 482/5

* cited by examiner

*Primary Examiner*—Loan Thanh
*Assistant Examiner*—Shila Abyaneh

(57) ABSTRACT

A training device includes a motor including a sensor member connected therewith which is electrically connected to a vibration control unit which controls the motor via commands from a user. A torque output unit is connected with an output shaft of the motor and transfers a resistant force to users and to transfers the force from the user to the motor. The torque output unit includes a speed reduction unit and a tension unit so as to transfer proper force between the motor and the users. The vibration control unit sensing status of the motor according to input commands so as to control the motor simultaneously to generate vibration and resistant force on user's muscles by rotating to-and-fro repetitively.

2 Claims, 7 Drawing Sheets

VIBRATION TRAINING DEVICE

CROSS-REFERENCE TO RELATED APPLICATION

This application is a Continuation-In-Part application of Ser. No. 11/979,476, filed 5 Nov. 2007, and entitled "VIBRATION TRAINING DEVICE", now pending.

BACKGROUND OF THE INVENTION

1. Field of the Invention

The present invention relates to a Vibration Training device for enhancing muscles power and nerves reaction.

2. Description of Related Art

An athlete needs strong muscles which reacts fast in the games. and the power is a conduct of muscles force and velocity of the retraction of the muscles. The method for enhancing the force of the muscles is to include the number of fibers of the muscles and to increase the size of the muscles. The method for increasing the reaction of the muscles is to train the sensitivity of the nerves so as to enhance the efficiency and speed for dominating the reaction of muscles.

A conventional training device is shown in FIG. 1 and generally includes a frame with pulleys connected thereto and a cable has one end connected with a weight and the other end reeve through the pulleys and pulled by the user. The user pulls the cable to lift the weight to exercise his or her muscles. This type of device can only exercise the muscles and cannot help increase the response of nerves of the user. FIG. 2 shows another training device which is similar to the device disclosed in FIG. 1 and a vibration unit is cooperated with the cable so that when the user pulls the weight upward, the vibration unit provides vibration to the cable. The vibration unit provides a periodical vibration mode to stimulate the reaction of the nerves of the user so that the user has to use more exercising parts of his or her body to deal with the vibration.

The conventional training devices are huge so that most of the users cannot have their own training devices at homes.

The present invention intends to provide a training device which uses a motor cooperated with a torque output unit and a speed reduction unit to generate resistant force when the user operates the training device, and the torque output unit changes the modes of the resistance so as to train the speed of the nerves of the user.

SUMMARY OF THE INVENTION

The present invention relates to a training device that comprises a motor including a sensor member connected therewith which is electrically connected to a vibration control unit which controls the motor. The sensor member is provided for detecting a speed of the motor and an angular degree of the motor. The vibration control unit has a control panel electrically connected thereto. The control panel is provided for commanding the motor simultaneously to generate vibration and resistant force on a user's muscle. A torque output unit is connected with an output shaft of the motor and adapted to transfer a resistant force to the user. The torque output unit includes a speed reduction unit and a tension unit. The speed reduction unit includes a first reduction wheel connected to the output shaft of the motor and a second reduction wheel. A transmission belt is connected between the first reduction wheel and the second reduction wheel for adapting to transfer the motor from a lower output torque with higher revolutions to a higher output torque with lower revolutions. The second speed reduction wheel is connected to the tension unit. The tension unit includes a tension wheel connected to the second speed reduction wheel. A cable is connected to the tension wheel and a handle connected to the cable. A reposition sensor is disposed adjacent to the tension wheel and electrically connected to the controller. The reposition sensor is provided for detecting a position of the cable and the handle for determining the user to achieve a full training cycle and confirming the cable and the handle to return an initial position. A strength sensor is disposed between the cable and the handle. The strength sensor is electrically connected to the vibration control unit. The strength sensor is provided for detecting the user's input force and sending a signal to the vibration control unit such that the vibration control unit gets a feedback to correctly control the motor. The user holds the handle and pulls the cable to transfer an operation force to the motor via the tension unit and the speed reduction unit. The vibration control unit senses status of the motor according to input commands and the strength sensor so as to control the motor simultaneously to generate vibration and resistant force on user's muscles by rotating to-and-fro repetitively.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
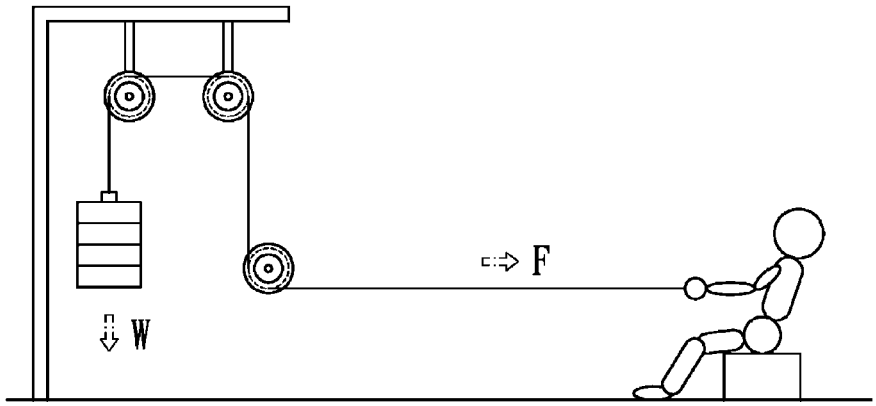
FIG. 1 shows that a user uses a first conventional training device.
Figure 2:
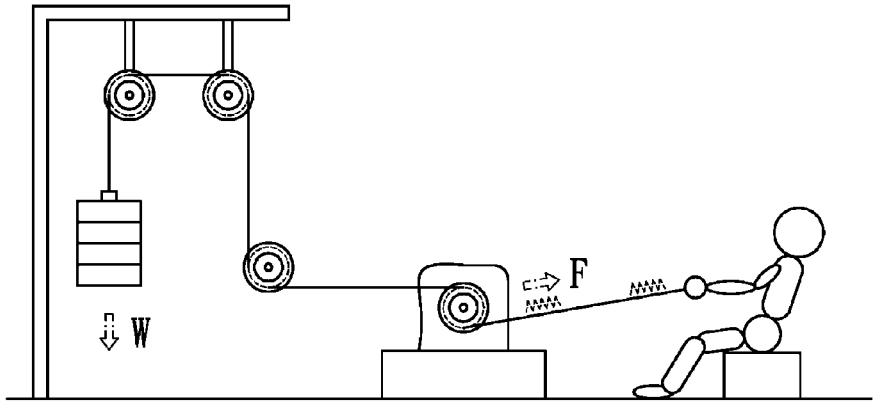
FIG. 2 shows that a user users a second conventional training device.
Figure 3:
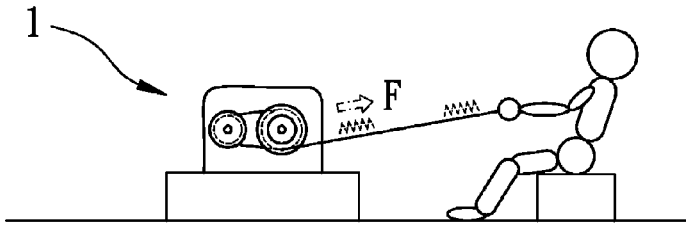
FIG. 3 shows that a user uses the training device of the present invention.
Figure 4:
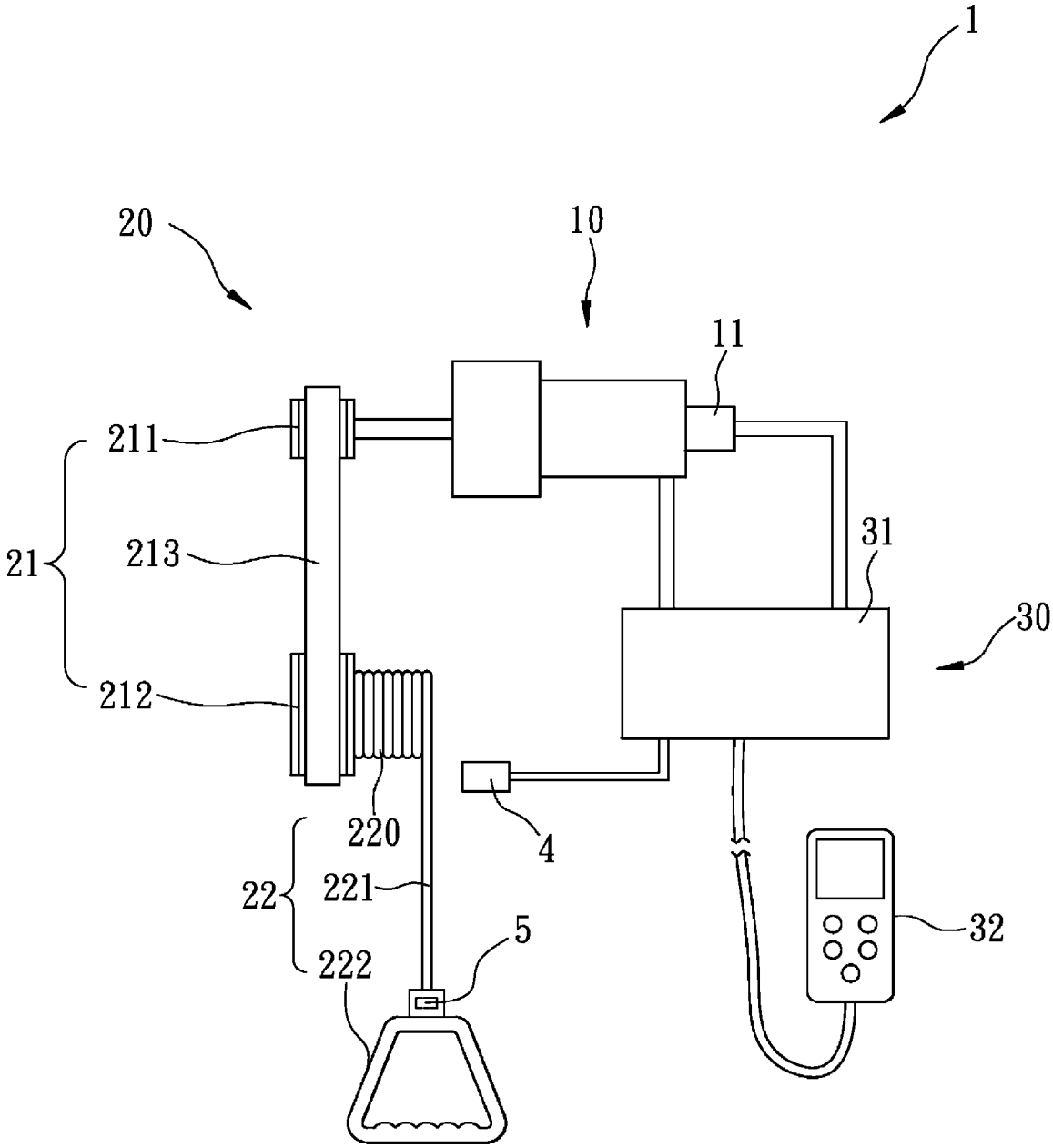
FIG. 4 shows the arrangement of the main parts of the training device of the present invention.

Referring to FIGS. 3 and 4, the training device 1 of the present invention comprises a motor 10, a torque output unit 20 and a vibration control unit 30. The motor 10 includes a sensor member 11 connected therewith which detects the angular degree and speed of the motor 10 and is electrically connected to the vibration control unit 30. The vibration control unit 30 has a controller 31 electrically connected to the sensor member 11 and the motor 10. The vibration control unit has a control panel 32 electrically connected to the controller 30. The control panel 32 is provided for commanding the motor 10 simultaneously to generate vibration and resistant force on a user's muscle.

The torque output unit 20 is connected with an output shaft of the motor 10 and includes a speed reduction unit 21 and a tension unit 22. The speed reduction unit 21 includes a first speed reduction wheel 211 which is connected to the output shaft of the motor 10 and a second speed reduction wheel 212. A transmission belt 213 is connected between the first and second speed reduction wheels 211, 212. The lower output torque with higher revolutions can be transferred to higher output torque with lower revolutions. The second speed reduction wheel 212 is connected with the tension unit 22 which includes a tension wheel 220. A cable 221 is connected to the tension wheel 220 and a handle 222 is connected to the cable 221. The user holds the handle 222 and pulls the cable 221 to transfer an operation force to the motor 10 via the tension unit 22 and the speed reduction unit 21, and the motor 10 generates a force to the user according to the commands via the control panel 32.

The vibration control unit 30 is provided for sensing status of the motor according input commands so as to control the motor 10 to generate vibration on user's muscles by rotating to-and-fro repetitively.

A reposition sensor 4 is disposed adjacent to the tension wheel 220 and electrically connected to the controller 31. The reposition sensor 4 is provided for detecting a position of the cable 221 for determining the user to achieve a full training cycle and confirming the cable 221 and the handle 222 to return an initial position.

A strength sensor 5 is disposed between the cable 221 and the handle 222. The strength sensor 5 is electrically connected to the controller 31 of the vibration control unit 30. The strength sensor 5 is provided for detecting the user's input force and sending a signal to the controller 31 of the vibration control unit 30 such that the controller 31 gets a feedback to correctly control the motor and form a closed loop.

The motor 10 is a brushless permanent magnet motor and includes the features including maximum power (Watt)/horse power (hp), maximum torque, and maximum inertial, maximum speed. The design parameters of the power and the inertial is the diameter of the motor 10, the speed is the number of magnetic poles and the torque is the thickness of the silicon disks. All of the parameters are set when the motor 10 is manufactured and the maximum revolutions (Nmax) and the torque constant (kt) are pre-set values.

$Kt=C\times VD/Nmax$;

VD: terminal voltage of the motor

C: constant=9.55 kt=torque constant of the motor (N-M)/A $Tm=A\times kt$;

Tm: output torque of the motor (N-M);

A: input current of the motor (Amp).

The output torque of the motor is proportional to the input current of the motor so that when controlling the current of the motor 10, the output torque of the motor 10 is controlled. The users can have higher output torque by inputting higher current via the operation of the control panel 32.

Figure 5:
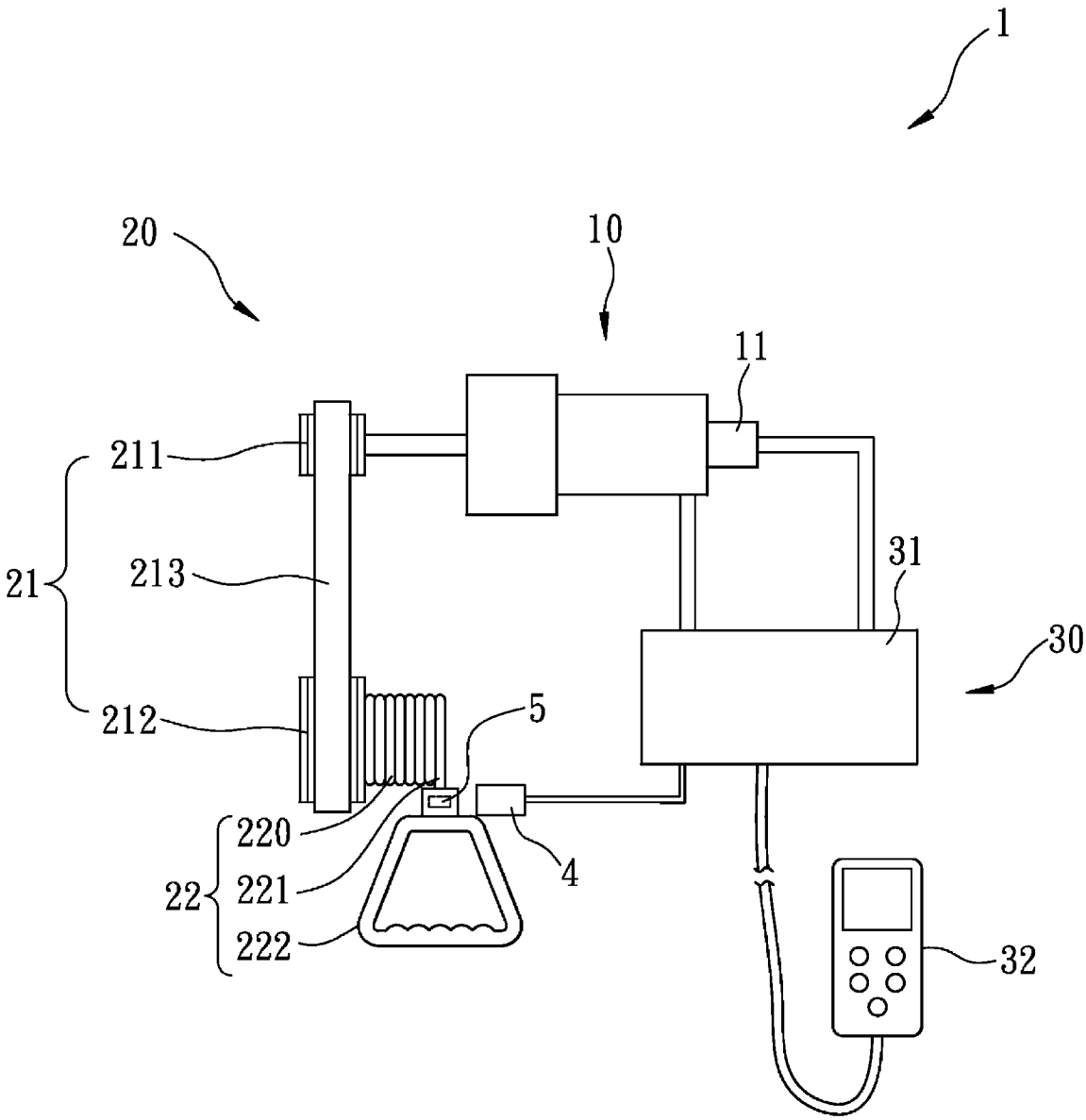
FIG. 5 shows the reposition sensor of the training device of the present invention detecting an initial position of the cable and the handle.
Figure 6:
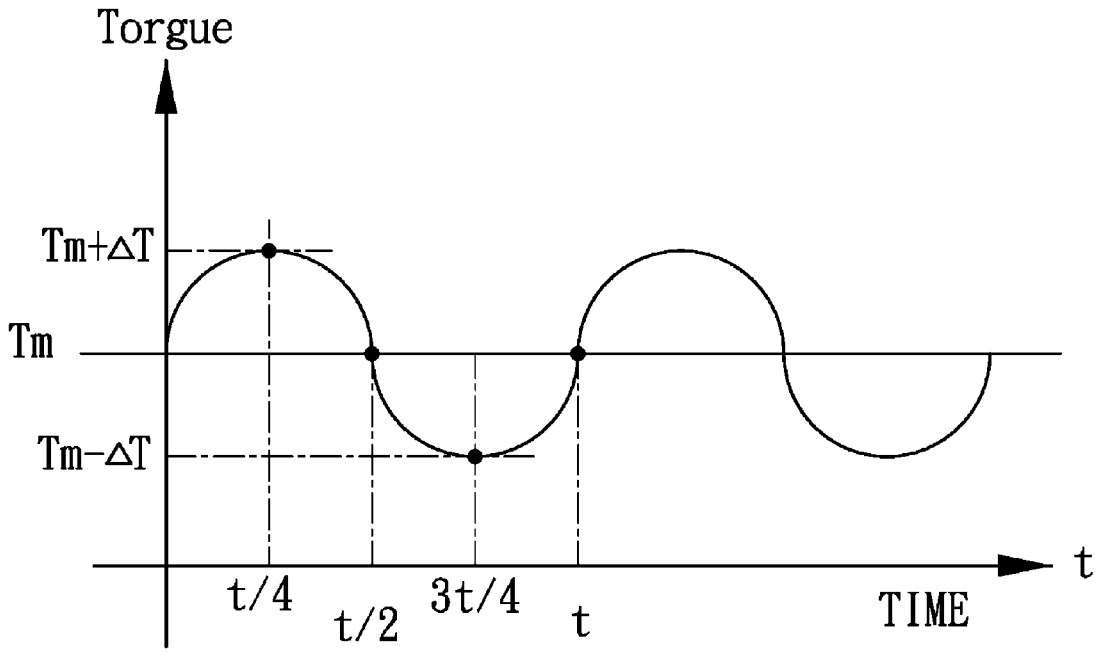
FIG. 6 shows the relationship between the torque and time of the training device of the present invention.

As shown in FIG. 5 which shows the relationship between the torque and time of the training device 1 of the present invention, wherein:

The radius of the tension wheel 220: r3;

The ratio of the speed reduction at the output shaft of the motor 10 is r2/r1;

The radius of the first speed reduction wheel 211: r1;

The radius of the second speed reduction wheel 212: r2;

The operation force from the user: F;

The torque applied to the tension wheel 220 from the user: Tr;

$Tr=F\times r3$;

$Fr=Tr/r2=(F\times r3)/R2$;

Tr applies the force Fr to the second speed reduction wheel 212.

The torque that the motor 10 has to generate is Tm so as to balance the torque transferred to the motor 10 via the speed reduction unit 21.

$Tm=Fr\times r1=(F\times r3\times r1)/r2$;

Tm is the upper limit of the torque that the motor outputs and set by users.

When the user has not yet apply a force to the handle 222, the sensor member 11 does not detect any operation of the motor 10 so that the controller 31 does not supply current to the motor 10. When the user applies an operation force which is less than the Tm, the controller 31 inputs a current to the motor 10 to against and balance the operation force.

When the operation force applies a torque which is equal to the Tm, the user cannot pull the cable 221 because the two forces are in a balance status.

When the operation force applies a torque which is larger than the Tm, because the controller 31 commands the motor 10 to generate the torque now is smaller than the torque applied by the user, the cable 221 and the handle 222 are pulled away from the tension unit 22 by the user. The sensor member 11 detects the angle that the motor 10 is pulled and the controller 31 memorizes the angle.

When the operation force applies a torque which is smaller than the Tm, because the controller 31 commands the motor 10 to generate the torque now is larger than the torque applied by the user, the cable 221 and the handle 222 are pulled toward the tension unit 22 by the motor 10.

Therefore, the user's muscles are exercised by the fixed Tm from the motor 10.

The training device 1 includes a second operation mode which uses the controller 31 to set the output torque from the motor 10 according to the Tm, and further sets the torque periodically in a form of sine or cosine waves.

t: the period of time of a cycle (unit: seconds)

f=1/t the frequency of the torque (unit: Hz)

ΔT: the change of the torque

When t=0, the Tm generated by the motor 10 is equal to the torque by the operation force of the user, the cable 221 is remained still.

When the value of t is between 0 and t/2, the force generated by the motor 10 is larger than the operation force. When t=t/4, the maximum torque is Tm+ΔT, the cable 221 is pulled by the motor 10.

When the value of t is equal to t/2, the torque Tm generated by the motor 10 is equal to the torque by the user, the cable 221 is remained still again.

When the value of t is between t/2 and t, the force generated by the motor 10 is smaller than the operation force. When t=3t/4, the minimum torque is Tm−ΔT, the cable 221 is pulled by the user.

The adjustment of the frequency f and the change of the torque ΔT, the user's muscles and the reaction of the user's nerves is exercised.

Figure 7:
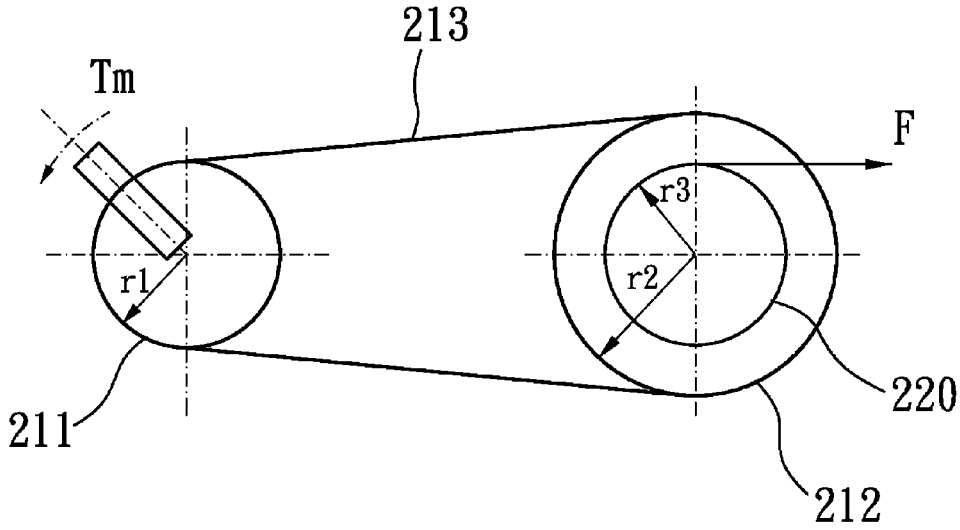
FIG. 7 shows the size relationship of the first speed reduction wheel, the second speed reduction wheel and the tension wheel of the speed reduction unit of the training device of the present invention.

FIG. 7 shows a second embodiment of the training device 1, wherein the tension unit 22 is replaced by a crank 223 and the user can use hands or feet to operate the crank 223 to drive the speed reduction unit 21. When the user's input force is larger than the force generated by the motor 10, the motor 10 is rotated in opposite direction by the user. When the user's input force is smaller than the force generated by the motor 10 or the user does not applies any force on the crank, the motor 10 does not generate torque a and the crank 223 is remained still.

Figure 8:
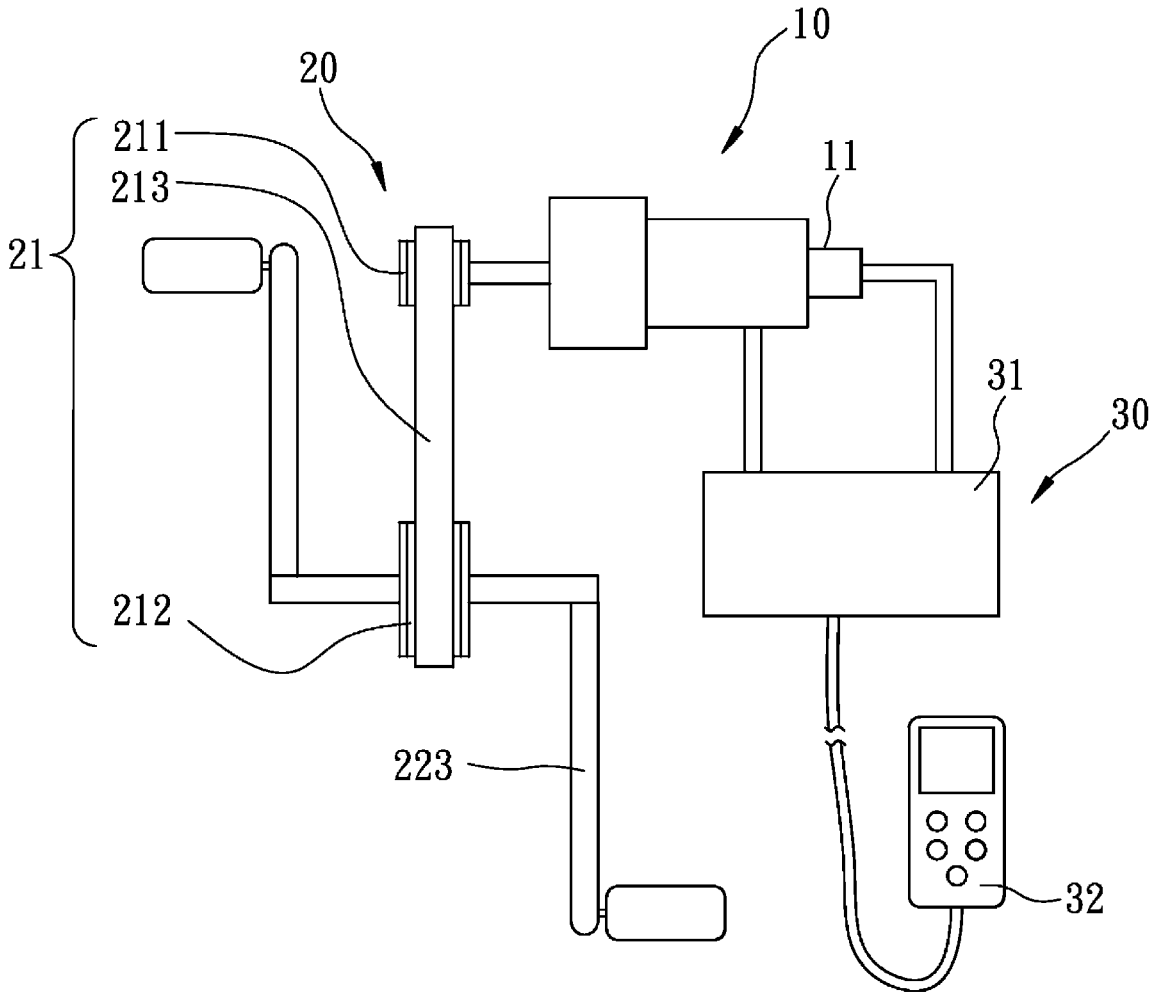
FIG. 8 shows a second embodiment of the training device of the present invention.
Figure 9:
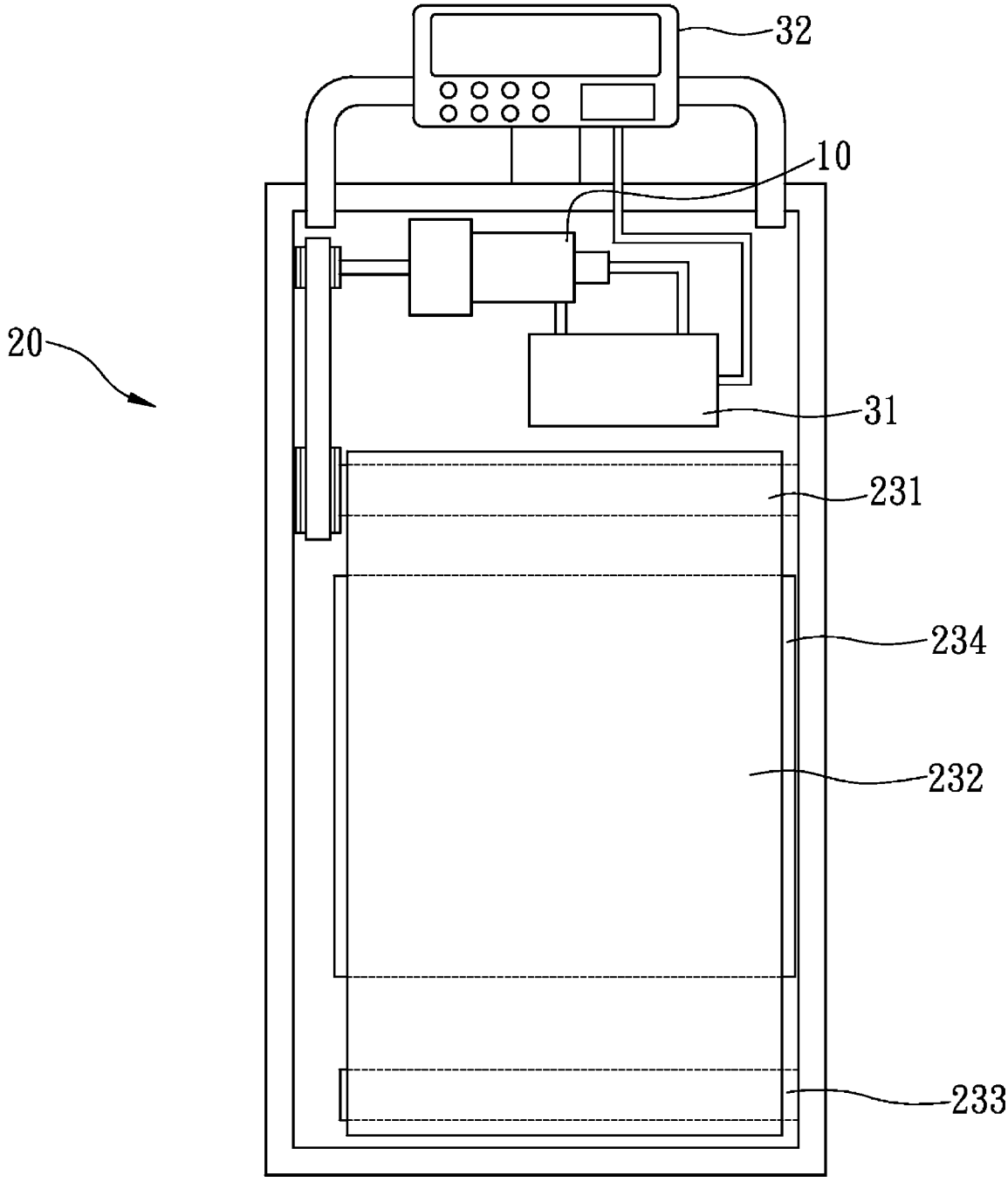
FIG. 9 shows a third embodiment of the training device of the present invention.
Figure 10:
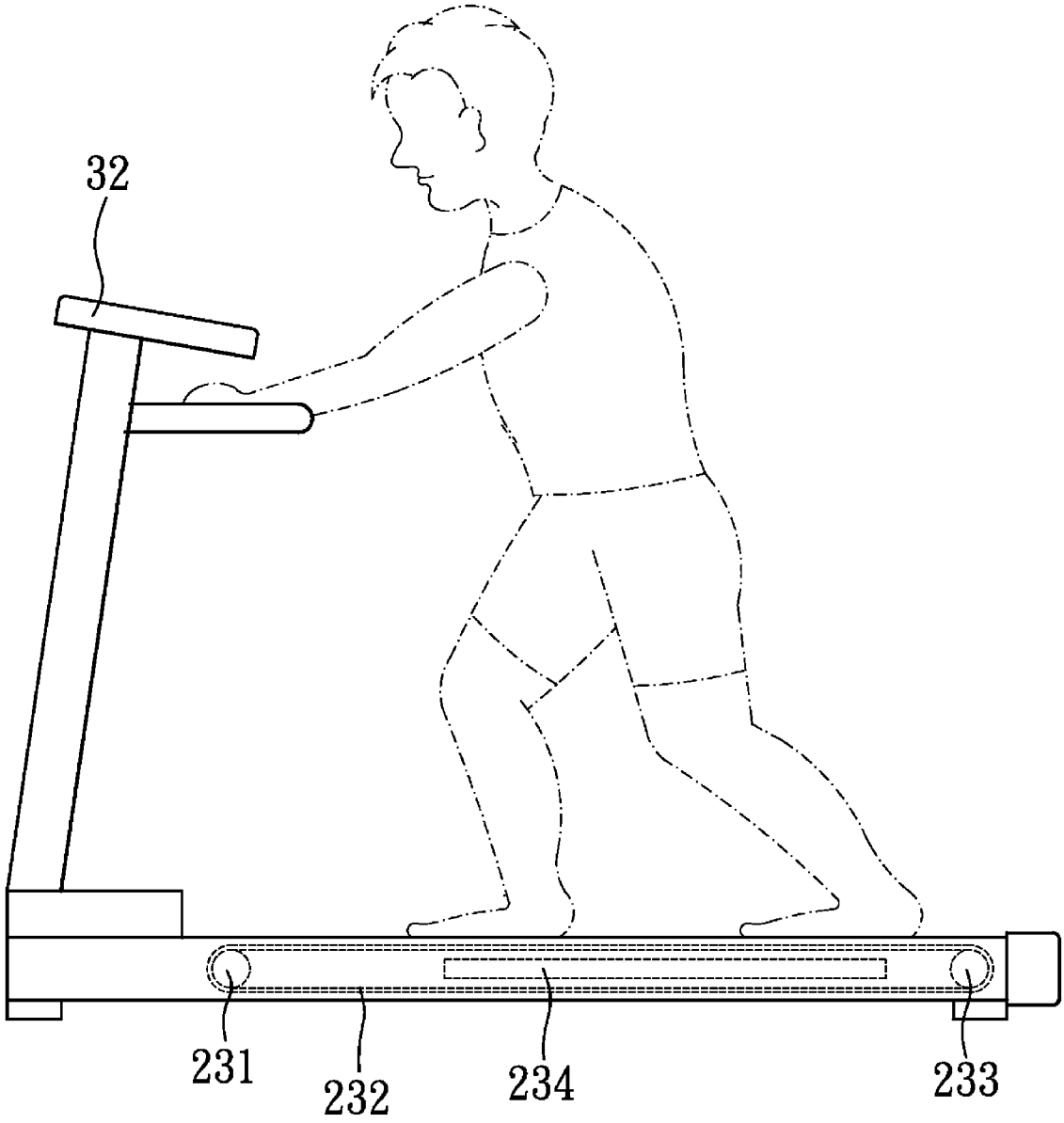
FIG. 10 shows a user uses the third embodiment of the training device of the present invention.

FIGS. 8 and 9 show a third embodiment of the training device 1, wherein the tension unit 22 is replaced by a driving shaft 231 which is connected with the second speed reduction wheel 212. An endless belt 232 is connected between the driving shaft 231 and another shaft 233, and a support board 234 is located beneath of the top surface of the endless belt 232. The training device 1 can be used as a treadmill While we have shown and described the embodiment in accordance with the present invention, it should be clear to those skilled in the art that further embodiments may be made without departing from the scope of the present invention.

What is claimed is:

1. A vibration training device comprising:

a motor including a sensor member connected therewith which is electrically connected to a vibration control unit which controls the motor, the sensor member provided for detecting a speed of the motor and an angular degree of the motor, the vibration control unit having a control panel and a controller electrically connected thereto, wherein the control panel provided for commanding the motor simultaneously to generate vibration and resistant force on a user's muscle;

a torque output unit connected with an output shaft of the motor and adapted to transfer a resistant force to the user; the torque output unit including a speed reduction unit and a tension unit, the speed reduction unit including a first reduction wheel connected to the output shaft of the motor and a second reduction wheel, a transmission belt connected between the first reduction wheel and the second reduction wheel for adapting to transfer the motor from a lower output torque with higher revolutions to a higher output torque with lower revolutions, the second speed reduction wheel connected to the tension unit; the tension unit including a tension wheel connected to the second speed reduction wheel, a cable connected to the tension wheel and a handle connected to the cable;

a reposition sensor disposed adjacent to the tension wheel and electrically connected to the controller, the reposition sensor provided for detecting a position of the cable for determining the user to achieve a full training cycle and confirming the cable and the handle to return an initial position;

a strength sensor disposed between the cable and the handle, the strength sensor electrically connected to the vibration control unit, the strength sensor provided for detecting the user's input force and sending a signal to the vibration control unit such that the vibration control unit gets a feedback to correctly control the motor;

wherein the user holds the handle and pulls the cable to transfer an operation force to the motor via the tension unit and the speed reduction unit; the vibration control unit sensing status of the motor according to input commands and the strength sensor so as to control the motor simultaneously to generate vibration and resistant force on user's muscles by rotating to-and-fro repetitively.

2. The device as claimed in claim 1, wherein the resistant force and frequency and amplitude of the vibration on user's muscles are adjusted independently and separately.

* * * * *